US011407611B2

(12) United States Patent
Kuusinen et al.

(10) Patent No.: US 11,407,611 B2
(45) Date of Patent: Aug. 9, 2022

(54) COMPUTING ALLOCATION DECISIONS IN AN ELEVATOR SYSTEM

(71) Applicant: KONE Corporation, Helsinki (FI)

(72) Inventors: Juha-Matti Kuusinen, Helsinki (FI); Mirko Ruokokoski, Helsinki (FI); Henri Hakonen, Helsinki (FI); Janne Sorsa, Helsinki (FI)

(73) Assignee: KONE CORPORATION, Helsinki (FI)

( * ) Notice: Subject to any disclaimer, the term of this patent is extended or adjusted under 35 U.S.C. 154(b) by 811 days.

(21) Appl. No.: 16/214,565

(22) Filed: Dec. 10, 2018

(65) Prior Publication Data

US 2019/0106289 A1 Apr. 11, 2019

Related U.S. Application Data

(63) Continuation of application No. PCT/FI2016/050441, filed on Jun. 17, 2016.

(51) Int. Cl.

| | |
|---|---|
| ***B66B 1/24*** | (2006.01) |
| ***B66B 1/34*** | (2006.01) |
| ***B66B 5/00*** | (2006.01) |

(52) U.S. Cl.

CPC ..... *B66B 1/2458* (2013.01); *B66B 1/3407* (2013.01); *B66B 1/3446* (2013.01);

(Continued)

(58) Field of Classification Search

CPC ... B66B 1/2458; B66B 1/3407; B66B 1/3446; B66B 5/0037; B66B 2201/103;

(Continued)

(56) References Cited

U.S. PATENT DOCUMENTS 4,760,896 A * 8/1988 Yamaguchi ..... B66B 1/2458 187/382

5,250,766 A 10/1993 Hikita et al.

(Continued)

FOREIGN PATENT DOCUMENTS

CN 1056659 A 12/1991
CN 1301232 A 6/2001

(Continued)

OTHER PUBLICATIONS

International Preliminary Report on Patentability, issued in PCT/FI2016/050441, dated Oct. 16, 2018.

(Continued)

*Primary Examiner* — Jeffrey Donels

(74) *Attorney, Agent, or Firm* — Birch, Stewart, Kolasch & Birch, LLP

(57) ABSTRACT

A method and an apparatus for computing allocation decisions in an elevator system is provided. Historical passenger batch journey data relating to the elevator system is obtained, wherein each passenger batch journey includes an origin and a destination floor of the journey, the number of passengers of the journey and the time of the journey. Historical passenger traffic statistics are constructed based on the passenger batch journey data, and expected calls are modelled based on the passenger traffic statistics. The modelled expected call is taken into account in computing subsequent allocation decisions in the elevator system.

20 Claims, 4 Drawing Sheets

(52) U.S. Cl.
CPC ..... *B66B 5/0037* (2013.01); *B66B 2201/103* (2013.01); *B66B 2201/214* (2013.01); *B66B 2201/222* (2013.01); *B66B 2201/235* (2013.01); *B66B 2201/243* (2013.01); *B66B 2201/402* (2013.01)

(58) Field of Classification Search
CPC ..... B66B 2201/214; B66B 2201/222; B66B 2201/235; B66B 2201/243; B66B 2201/402
See application file for complete search history.

(56) References Cited

U.S. PATENT DOCUMENTS

| | | | | |
|---|---|---|---|---|
| 6,237,721 | B1 * | 5/2001 | Siikonen | B66B 1/2458 187/382 |
| 6,328,134 | B1 | 12/2001 | Hikita | |
| 6,345,697 | B1 | 2/2002 | Siikonen | |
| 6,360,849 | B1 * | 3/2002 | Hikita | B66B 1/18 187/381 |
| 7,083,027 | B2 * | 8/2006 | Siikonen | B66B 1/2458 187/383 |
| 10,843,895 | B2 * | 11/2020 | Salmikuukka | B66B 25/003 |
| 2006/0289243 | A1 | 12/2006 | Hikita et al. | |
| 2012/0090922 | A1 * | 4/2012 | Elomaa | B66B 1/2458 187/247 |
| 2017/0081148 | A1 * | 3/2017 | Salmikuukka | B66B 1/3407 |

FOREIGN PATENT DOCUMENTS

| | | | |
|---|---|---|---|
| CN | 1315284 | A | 10/2001 |
| CN | 1802303 | A | 7/2006 |
| CN | 101830375 | A | 9/2010 |
| CN | 102190221 | A | 9/2011 |
| CN | 103863912 | A | 6/2014 |
| CN | 104891284 | A | 9/2015 |
| EP | 0 090 642 | A2 | 10/1983 |
| EP | 0452225 | A2 | 10/1991 |
| JP | 10-236742 | A | 9/1998 |
| JP | 4690703 | B2 | 6/2011 |
| WO | WO 99/21787 | A1 | 5/1999 |

OTHER PUBLICATIONS

International Search Report, issued in PCT/FI2016/050441, dated Dec. 30, 2016.

Kuusinen et al, "A new concept for passenger traffic in elevators", Informs Annual Meeting Oct. 11-14, 2009, San Diego, USA [retrieved on Dec. 27, 2016]. Retrieved from the Internet: <URL: http://sal.aalto.fi/publicattons/ppt-files/jmkuu09s.ppt>, pp. 1-20.

Ruokokoski et al. "Passenger Allocation to Capacitated Elevator Problem, manuscript 2.1 Oct. 22, 2008" [online][retrieved on Oct. 12, 2018]. Retrieved from the internet: <URL: http://sal.aalto.fi/publications/pdf-files/mruo08.pdf>, pp. 1-26.

Written Opinion of the International Searching Authority, issued in PCT/FI2016/050441, dated Dec. 30, 2016.

* cited by examiner

COMPUTING ALLOCATION DECISIONS IN AN ELEVATOR SYSTEM

CROSS REFERENCE TO RELATED APPLICATIONS

This application is a Continuation of PCT International Application No. PCT/FI2016/050441, filed on Jun. 17, 2016, which is hereby expressly incorporated by reference into the present application.

BACKGROUND

Elevator control in an elevator system may enable reallocation of a call after an initial call allocation. This means that, in some cases, it would be beneficial to reassign a new elevator to an already existing call. The situation is, however, different, for example, in elevator systems using immediate call allocation. One example of the immediate call allocation is a destination control system (DCS). In the immediate call allocation, already allocated calls are not typically be reassigned. This may lead to a situation that after allocating a call to a first elevator, it may turn out that it would be more beneficial and optimal to serve the call with a second elevator. But, as already mentioned above, it may not be possible to reassign the call of the already allocated call to the first elevator since in the destination control system the serving (allocated) elevator is signaled to the passengers immediately after giving a call.

Further, an elevator may become full before it has served all the calls and passengers assigned to it. This, on the other hand, may result in reduced passenger service level especially in destination control systems.

SUMMARY

According to a first aspect of the invention, there is provided a method for computing allocation decisions in an elevator system. The method comprises obtaining historical passenger batch journey data relating to the elevator system, wherein each passenger batch journey comprises an origin and a destination floor of the journey, the number of passengers of the journey and the time of the journey; constructing historical passenger traffic statistics based on the passenger batch journey data; modelling expected calls based on the passenger traffic statistics; and taking the modelled expected call into account in computing subsequent allocation decisions in the elevator system.

In one embodiment, the method further comprises estimating elevator load in elevators of the elevator system based on the historical passenger traffic statistics; and taking the estimated elevator load into account in computing subsequent allocation decisions in the elevator system.

In one embodiment, alternatively or in addition, the method further comprises estimating elevator load in elevators of the elevator system separately for each elevator trip based on passenger batch journey intensities and batch size distributions obtained from the historical passenger traffic statistics, and simulated service times.

In one embodiment, alternatively or in addition, the modelled expected calls comprise at least one landing and car call pair.

In one embodiment, alternatively or in addition, the modelled expected calls comprise at least one destination call.

In one embodiment, alternatively or in addition, the passenger batch journey data comprises building origin-destination matrices formed separately for each day within a predetermined day cycle.

In one embodiment, alternatively or in addition, the elevator system uses immediate call allocation.

According to a second aspect, there is provided an elevator control apparatus for computing allocation decisions in an elevator system. The apparatus comprises at least one processor and at least one memory connected to the at least one processor. The at least one memory stores program instructions that, when executed by the at least one processor, cause the apparatus to obtain historical passenger batch journey data relating to the elevator system, wherein each passenger batch journey comprises an origin and a destination floor of the journey, the number of passengers of the journey and the time of the journey; construct historical passenger traffic statistics based on the passenger batch journey data; model expected calls based on the passenger traffic statistics; and take the modelled expected call into account in computing subsequent allocation decisions in the elevator system.

In one embodiment, the at least one memory stores program instructions that, when executed by the at least one processor, cause the apparatus to estimate elevator load in elevators of the elevator system based on the historical passenger traffic statistics; and take the estimated elevator load into account in computing subsequent allocation decisions in the elevator system.

In one embodiment, the at least one memory stores program instructions that, when executed by the at least one processor, cause the apparatus to estimate elevator load in elevators of the elevator system separately for each elevator trip based on passenger batch journey intensities and batch size distributions obtained from the historical passenger traffic statistics, and simulated service times.

In one embodiment, alternatively or in addition, the modelled expected calls comprise at least one landing and car call pair.

In one embodiment, alternatively or in addition, the modelled expected calls comprise at least one destination call.

In one embodiment, alternatively or in addition, the passenger batch journey data comprises building origin-destination matrices formed separately for each day within a predetermined day cycle.

In one embodiment, alternatively or in addition, the elevator system uses immediate call allocation.

According to a third aspect, there is provided a computer program comprising program code, which when executed by at least one processing unit, causes the at least one processing unit to perform the method of the first aspect.

In one embodiment, the computer program is embodied on a computer readable medium.

According to a third aspect, there is provided an elevator system comprising a plurality of elevators and an elevator control apparatus according to the second aspect.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1A:
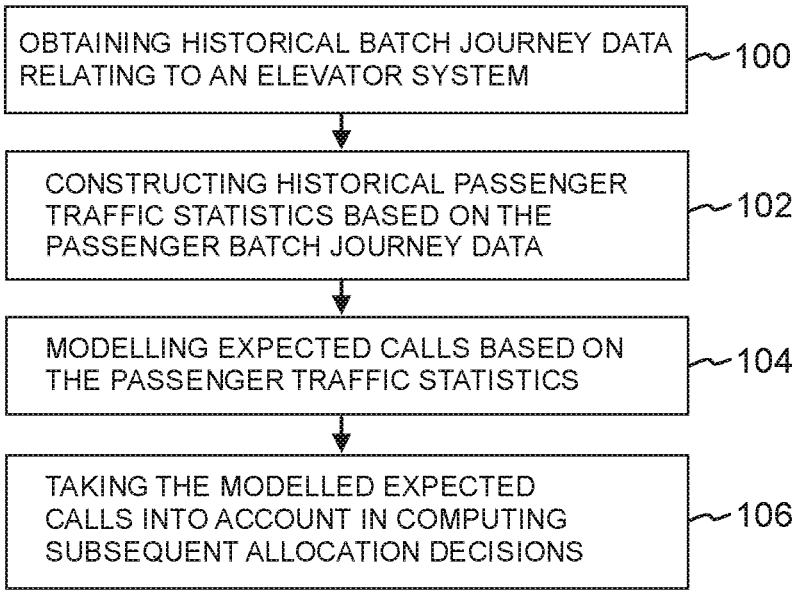
FIG. 1A is a flow diagram illustrating a method for computing allocation decisions in an elevator system.

FIG. 1A is a flow diagram illustrating a method for computing allocation decisions in an elevator system.

At 100 historical passenger batch journey data relating to the elevator system is obtained. Each passenger batch journey comprises an origin and a destination floor of the journey, the number of passengers (i.e. the passenger batch size) of the journey and the time of the journey. The passenger batch journey data provides historical, realized data about the usage of elevators in the elevator system.

At 102 historical passenger traffic statistics are constructed based on the passenger batch journey data. The historical passenger traffic statistics may be based on building origin-destination (OD) matrices which in turn may be based on the passenger batch journeys discussed above. A building specific OD matrix may be formed separately for each day d, d=1, 2, . . . , D, where D is the number of days in a cycle, and fixed intervals $[t_k, t_{k+}1]$, k=1, 2, . . . , K, where K is the number of intervals within a day. For example, if D is set to "7", the building specific OD matrix covers each weekday.

A N×N building specific OD matrix can be denoted as $\Lambda_{kd}^{b}$, where N is the number of floors in the building and b, b=1, 2, . . . , B, denotes a batch size (i.e. the number of passengers). The element $\lambda_{ijkd}^{b}$ in the building specific OD matrix corresponds to the intensity of passenger batch journeys equal to the batch size b from an origin floor i to a destination floor j within an interval k of a day d.

In the elevator group control, each candidate solution gives the allocation of the calls for the elevators in the group. In order to calculate the cost or fitness value of a solution, the service order of the calls or passengers for each elevator has to be determined. This can be done for each elevator independently from each other, for example, as follows.

Suppose there exists a given a set of calls, some of which can be dummy calls. First, the service order of the calls is determined by the collective control principle. Then, the route of the elevator through the calls is simulated in that order. The calls can be represented with nodes. A landing call corresponds to a single origin node and a destination call to an origin and destination node. Let $N=[n_1, n_2, \ldots, n_k]$ denote the ordered set of nodes. The service time $t_i$ of a call $n_1$ can be recursively calculated as $t_i=t_{i-1}+\tau_{i-1,i}$, where $\tau_{ij}$ is the time to go from a node $n_i$ to a node $n_j$, that is, the flight time from the node $n_i$ to a node $n_j$, plus the stop time at the node $n_i$. A node $n_0$ is the current location of the elevator, $t_0=0$ and $\tau_{01}$, is the flight time between the current location of the elevator and the first node $n_1$.

If $n_i$ corresponds to a landing call, existing or dummy, a set of dummy car calls that can be assumed to be given when the landing call $n_i$ is served, are modelled and added to the route in right places. Table 1 lists examples of different call types and items that can be modelled.

TABLE 1

| Call type | Modelled items |
|---|---|
| Existing landing call | A set of car calls that will be given by the passengers behind the call |

TABLE 1-continued

| Call type | Modelled items |
|---|---|
| Dummy landing call | 1. The time when the dummy call will be given<br>2. A set of car calls that will be given by the passengers behind the call |
| Existing destination call, car call buttons | A set of car calls that will be given by the passengers behind the call |
| Dummy destination call, no car call buttons | The time when the dummy call will be given |
| Dummy destination call, car call buttons | 1. The time when the dummy call will be given<br>2. A set of car calls that will be given by the passengers behind the call |

Once the simulation is over, the service time of each call is determined. Then the fitness value of each candidate solution, that is, allocation of calls, can be calculated using an objective function. A typical objective function is the average waiting time, the average journey time or the weighted sum of these two.

At 104 expected calls (or "dummy" calls) are modelled based on the passenger traffic statistics. Let $\Lambda_{kd}=\Sigma_{b=1}^{B}\Lambda_{kd}^{b}$ denote a matrix containing the intensity of passenger batch journeys for each pair of floors within interval k of day d. An element $\lambda_{ijkd}$ is the intensity of journeys from an origin floor i to a destination floor j. It is also assumed herein that the batch journeys occur according to a Poisson process. Furthermore, the batch size distributions for each pair of floors may be defined by the matrices $\Lambda_{kd}^{1}$, $\Lambda_{kd}^{2}$, K, $\Lambda_{kd}^{B}$. By leaving out the interval and day indices, the time, $t_{ij}$, to the next pair of a dummy landing and car call, or a dummy destination call from an origin floor i to a destination floor j, can be defined as $$t_{ij} = \begin{cases} \max\left\{\frac{1}{\lambda_{ij}} - \gamma_{ij}, 0\right\} & \gamma_{ij} \le \hat{\gamma} \\ \frac{1}{\lambda_{ij}} & \text{otherwise} \end{cases}$$

where $\lambda_{ij}$ is the intensity of the batch arrivals occurring according to a Poisson process from an origin floor i to a destination floor j in seconds and $\gamma_{ij}$ is the time since the previous landing or destination call from the origin floor i to the destination floor j.

Because $\lambda_{ij}$ is the rate parameter of a Poisson process, $1/\lambda_{ij}$ is the average time between two successive arrivals, i.e. calls. The above equation then implies that even if we assume that the batch arrivals occur according to a Poisson process, the forgetfulness property of the process is assumed only if the time since the previous call is longer than the predefined time limit $\hat{\gamma}$. A suitable value for the time limit can be determined, for example, with simulation studies.

When $1/\lambda_{ij}<\gamma_{ij}$, i.e., there is a lot of traffic from the origin floor i to the destination floor j, and the time since the previous call is longer than the average inter-arrival time, then $t_{ij}<0$. In this case, it is natural to assume that the time to the next future call will be very short and thus we set $t_{ij}=0$. If $t_{ij}\in[0,\hat{t}]$, where $\hat{t}$ is a predefined time horizon, e.g., elevator cycle time, a pair of a dummy landing and car call, or a dummy destination call is generated from an origin floor i to a destination floor j with the arrival time equal to $t_{current}+t_{ij}$, where $t_{current}$ is, e.g., the moment of computing a new allocation decision.

There can be several destination calls per origin floor, and thus, all dummy destination calls from an origin floor i to a destination floor j such that $t_{ij} \in [0,\hat{t}]$ are generated. Because there can be only one landing call per direction on an origin floor i at a time, among all pairs of dummy landing and car calls to the same direction such that $t_{ij} \in [0,\hat{t}]$, the pair for which the arrival time is closest to the current time can be selected.

Let $l_i$ denote this arrival time, i.e. $l_i = \arg\min\{t_{ij} | 0 \le t_{ij} \le \hat{t}\}$.

Hence, the arrival time of the next dummy landing call on an origin floor i to the direction defined by the dummy car calls j such that $t_{ij} \in [0,\hat{t}]$ is $t_{current} + l_i$. Further, for example, if there is an existing landing call at the origin floor i, then only the dummy car calls to destination floors j such that $t_{ij} \in [0,\hat{t}]$ are generated.

At 106 at least one modelled expected (or "dummy") call is taken into account in computing subsequent allocation decisions. This improves the service level of passenger since the allocation of elevator cars becomes more optimized.

Figure 1B:
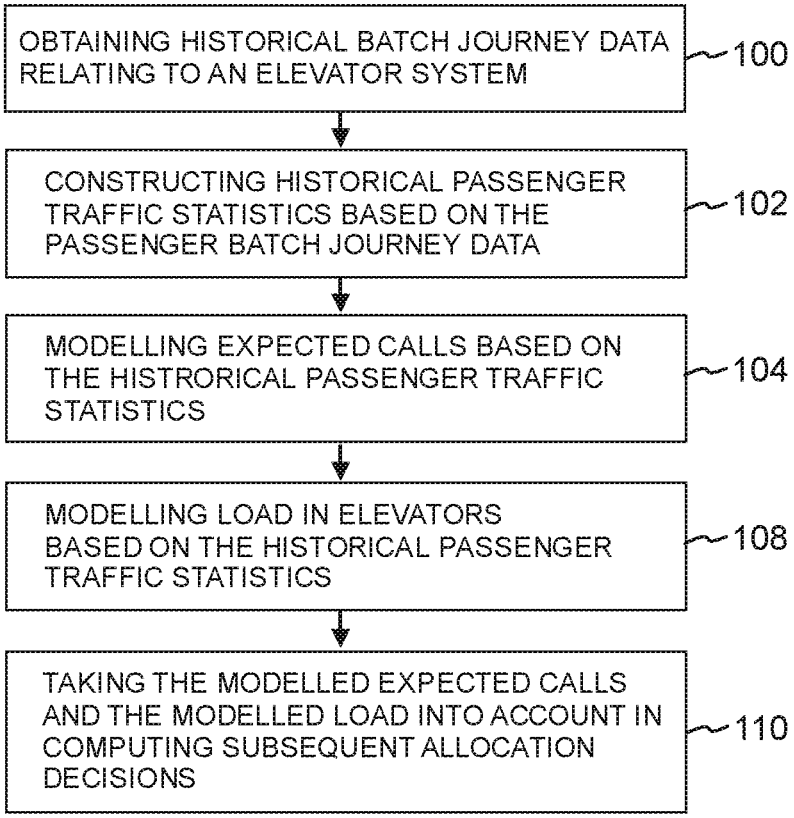
FIG. 1B is a flow diagram illustrating a method for computing allocation decisions in an elevator system.

FIG. 1B is a flow diagram illustrating a method for computing allocation decisions in an elevator system. The embodiment illustrated in FIG. 1B is similar to the one illustrated in FIG. 1A that already illustrates steps 100, 102 and 104.

At 108 load in elevators is modelled based on the historical passenger traffic statistics. For each dummy car call discussed in more detail in FIG. 1A and its description, the intensity at which passengers travel from an origin floor i to a destination floor j within interval k of day d is estimated as $$\mu_{ijkd} = \lambda_{ijkd} t_i E[Y_{ijkd}]$$

where $t_i$ is the serving time of the landing call on a floor I, and $t_i$ becomes defined during route simulation. $E[Y_{ijkd}]$ is the expected number of passengers related to each arrival, in other words, the expected batch size which is estimated using the batch size distribution defined by the matrices $\Lambda_{kd}^{1}, \Lambda_{kd}^{2}, K, \Lambda_{kd}^{B}$, as already illustrated earlier. $\lambda_{ijkd}$ is the intensity of batch arrivals from an origin floor i to a destination floor j, that is, an element in the matrix defined as $\Lambda_{kd} = \Sigma_{b=1}^{B} \Lambda_{kd}^{b}$.

The intensities are estimated similarly as for dummy calls, as already illustrated in the description of FIG. 1A. Furthermore, if there is an existing car or destination call to a floor ahead a floor where an existing or dummy landing call is served, the intensity for this pair of floors may also be estimated. The reason is that the passengers who board the elevator at the landing call floor may also be travelling to the floor defined by an existing car or destination call, not only to the floor defined by the dummy calls.

The estimated intensities with their origin and destination floor numbers may be stored in a memory. For existing car and destination calls that the elevator will actually serve, the intensities may be kept in the memory as long as they are not served at the destination floor. For dummy car and destination calls, the intensities may be kept in memory as long as it would still be possible to decelerate to the destination floor defined by the intensity. The destination floors of the estimated intensities can be represented with nodes.

When the simulation of an elevator route is over, all the destination nodes of the estimated intensities are iterated through in the order defined by the route. In course of the iteration, two rules may be used to separate the route into successive elevator trips. An elevator trip ends to the current destination node if:

1. The smallest origin node number of the intensities associated to the next destination node, if any, is larger (smaller) or equal to the largest (smallest) destination node number encountered so far when the elevator running direction is up (down).
2. The elevator changes its running direction at the node.

In one embodiment, the following steps are performed:

1. During the simulation of the route defined by the existing calls, dummy landing, car and destination calls are generated and the intensities are estimated based on the passenger batch journey statistics for the existing and dummy car and destination calls.
2. The destination nodes defined by the intensities are iterated through in their service order and the elevator route is divided into successive elevator trips using the two rules.

After the above two steps, the intensities related to each elevator trip are used to define the origin and destination floors of the elevator trip.

In one embodiment, next the load of the elevator is estimated for each elevator trip individually as follows.

Let $x_{ij}$ denote the number of individual passenger arrivals from a node i to a node j. Assuming that the arrivals occur according to a Poisson process, $x_{ij}$ follows a Poisson distribution with the rate parameter μij. The number of passengers in the elevator after a stop at a node k must not exceed the capacity of the elevator. Mathematically this is can written as follows:

$$\Sigma_{i=1}^{k} \Sigma_{j=k+1}^{P} x_{ij} \le Q$$

where Q is the elevator capacity and P is the number of nodes on the elevator trip.

Next, since $x_{ij}$ may not be accurately known, the uncertainty related to them is taken into account by requiring that the probability of exceeding the elevator capacity Q after a stop at the node k is smaller than some predefined small probability α. Assuming that $x_{ij}$ are independent, this can be expressed as follows:

$$Prob\left(\sum_{i=1}^{k} \sum_{j=k+1}^{P} x_{ij} > Q\right) \le \alpha$$

$$1 - Prob\left(\sum_{i=1}^{k} \sum_{j=k+1}^{P} x_{ij} \le Q\right) \le \alpha$$

$$1 - \sum_{q=0}^{Q} \frac{e^{-u}\mu^{q}}{q!} \le \alpha$$

where $\mu = \Sigma_{i=1}^{k} \Sigma_{j=k+1}^{P} \mu_{ij}$. The final equation above can be considered as a penalty term since the smaller the left hand side is, the more probable is that the elevator capacity will not be exceeded during the elevator trip. The penalty term for a single elevator trip can be written as follows:

$$\beta \max\left\{0, 1 - \sum_{q=0}^{Q} \frac{e^{-u}\mu^{q}}{q!} - \alpha\right\}$$

where β is a scaling factor whose value can be determined, for example, with computational experiments. It follows that the penalty term for the whole route is the sum of the above penalties for the individual elevator trips. The penalty term for the whole route may thus be used when is added to an objective function used. A typical objective function is the average waiting time, the average journey time or the weighted sum of these two.

At 110 the at least one modelled expected (or "dummy") call and the modelled load is taken into account in computing subsequent allocation decisions. An elevator group control is then able to construct and use historical passenger traffic statistics based on passenger batch journeys to estimate load of an elevator during its route through the calls allocated to it which, when taken into account in computing the allocation decisions, help to improve passenger service level.

Figure 2A:
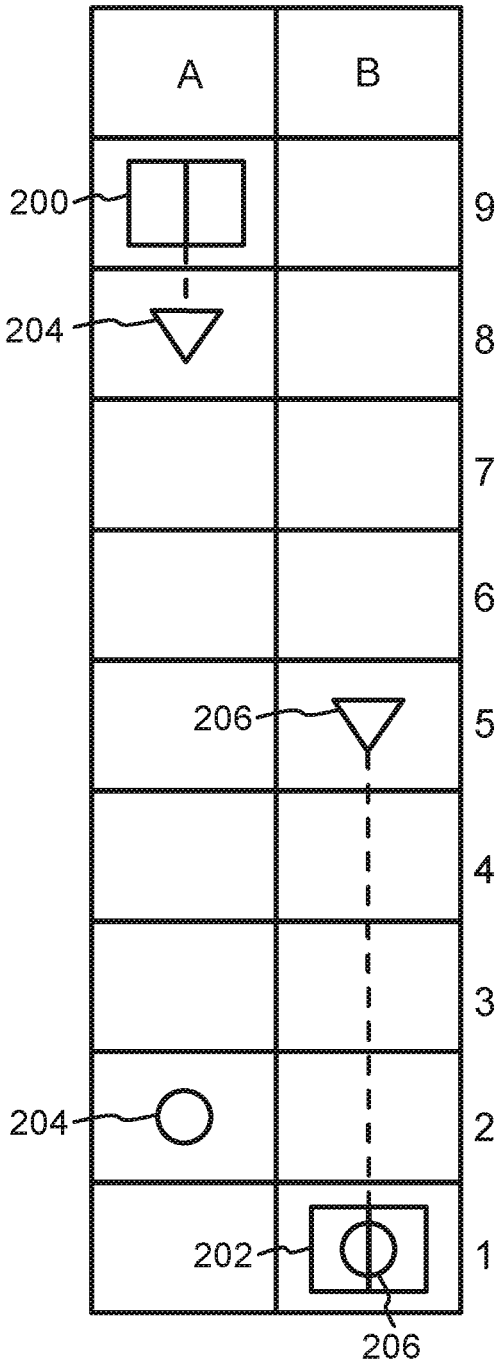
FIGS. 2A and 2B disclose an example illustrating making an allocation decision in an elevator system.
Figure 2B:
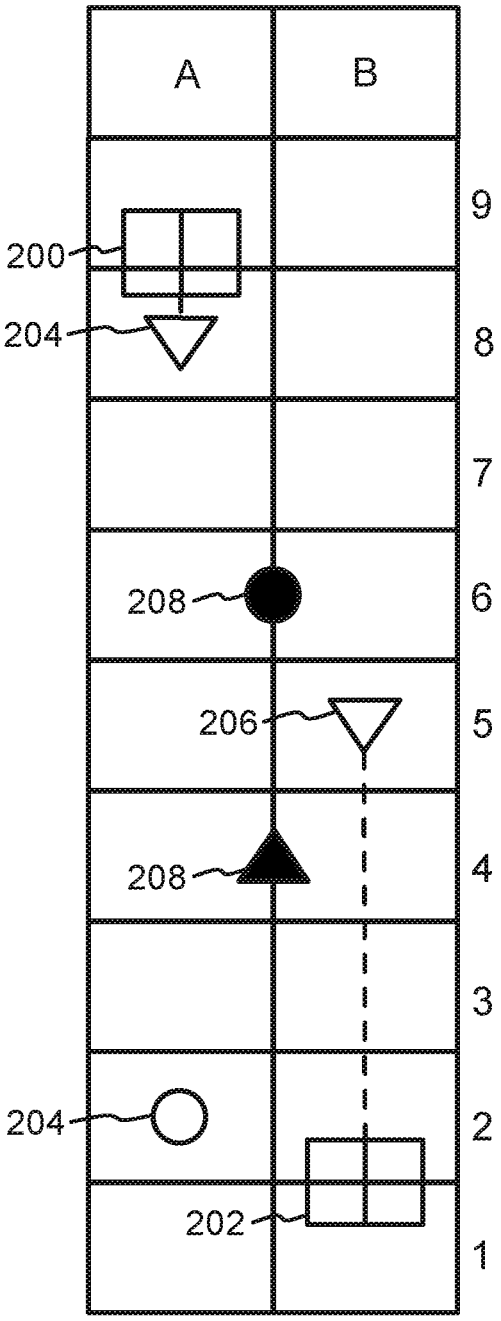

FIGS. 2A and 2B disclose an example illustrating making an allocation decision in an elevator system. The example assumes that a destination control system is used in a building with eight floors and two elevators, 200 and 202. It is also assumed that one of the elevators is at the top most floor, the floor 9, and the other one is at the bottom most floor, the floor 1.

In addition, it is assumed that two destination calls, one 204 from the floor 8 to the floor 2 and the other one 206 from the floor 5 to the floor 1, occur about the same time and that, based on minimizing the average waiting time, the first one is allocated to the first elevator 200 and the second one is allocated to the second elevator 202. Next, it is assumed that after about 5 seconds, when the elevators 200, 202 have started to move to serve the destination calls, a new destination call 208 is given from the floor 4 to the floor 6. This has been illustrated in FIG. 2B.

Now, from the average waiting time point of view, the best allocation would be to reassign the destination call from the floor 5 to the floor 1 for the first elevator 200 and to give the new destination call 208 to the second elevator 202. Normally, however, this would not be possible since in the destination control system the serving elevator is signaled to the passengers immediately after giving a call. However, as illustrated in the embodiment of FIG. 1A, this problem can be overcome when the new destination call is taken into account as a predicted or dummy destination call when allocating the first two calls. Therefore, in this case, the first and the second destination calls would be allocated to the first elevator 200 in the first place, and the second elevator 202 would then serve the subsequent new destination call 208.

Figure 3:
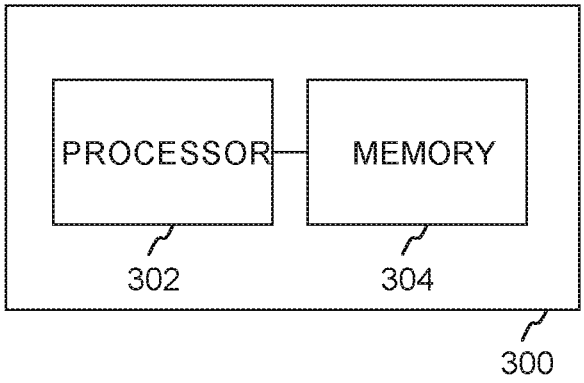
FIG. 3 is a block diagram illustrating an apparatus of operating elevator cars in a multi-car elevator system.

FIG. 3 illustrates a block diagram of an elevator control apparatus 300 for computing allocation decisions in an elevator system. The apparatus 300 comprises at least one processor 302 connected to at least one memory 304. The at least one memory 304 may comprise at least one computer program which, when executed by the processor 302 or processors, causes the apparatus 300 to perform the programmed functionality. The apparatus 300 may also comprise input/output ports and/or one or more physical connectors, which can be an Ethernet port, a Universal Serial Bus (USB) port, IEEE 1394 (FireWire) port, and/or RS-232 port. The illustrated components are not required or all-inclusive, as any components can deleted and other components can be added.

The elevator control apparatus 300 may be an elevator control entity configured to implement only the above disclosed operating features, or it may be part of a larger elevator control entity, for example, a group controller.

The exemplary embodiments of the invention can be included within any suitable device, for example, including, servers, workstations, personal computers, laptop computers, capable of performing the processes of the exemplary embodiments. The exemplary embodiments may also store information relating to various processes described herein.

Example embodiments may be implemented in software, hardware, application logic or a combination of software, hardware and application logic. The example embodiments can store information relating to various methods described herein. This information can be stored in one or more memories, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

All or a portion of the example embodiments can be conveniently implemented using one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments can be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice. Furthermore, in the claims means-plus-function clauses are intended to cover the structures described herein as performing the recited function and not only structural equivalents, but also equivalent structures.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. A method for computing allocation decisions in an elevator system that uses immediate call allocation, the method comprising the steps of:

obtaining historical passenger batch journey data relating to the elevator system, wherein each passenger batch journey comprises historical, realized date about origin and destination floors of past journeys, a number of passengers of the past journeys and time of the past journeys, within a predetermined day cycle;

constructing historical passenger traffic statistics based on the passenger batch journey data;

modelling expected calls in the future based on the historical passenger traffic statistics;

receiving at least one call; and taking at least one modelled expected call into account as a received call in computing allocation decisions for the at least one call in the elevator system.

2. The method according to claim 1, further comprising:

estimating elevator load in elevators of the elevator system based on the historical passenger traffic statistics; and taking the estimated elevator load into account in computing subsequent allocation decisions in the elevator system.

3. The method according to claim 2, further comprising:

estimating elevator load in elevators of the elevator system separately for each elevator trip based on passenger batch journey intensities and batch size distributions obtained from the historical passenger traffic statistics, and simulated service times.

4. The method according to claim 1, wherein the modelled expected calls comprise at least one landing and car call pair.

5. The method according to claim 1, wherein the modelled expected calls comprise at least one destination call.

6. The method according to claim 1, wherein the passenger batch journey data comprises building origin-destination matrices formed separately for each day within a predetermined day cycle.

7. An elevator control apparatus for computing allocation decisions in an elevator system that uses immediate call allocation, the apparatus comprising:

at least one processor; and at least one memory connected to the at least one processor, wherein the at least one memory stores program instructions that, when executed by the at least one processor, cause the apparatus to:

obtain historical passenger batch journey data relating to the elevator system, wherein each passenger batch journey comprises historical, realized date about origin and destination floors of past journeys, a number of passengers of the past journeys and time of the past journeys, within a predetermined day cycle;

construct historical passenger traffic statistics based on the passenger batch journey data;

model expected calls in the future based on the historical passenger traffic statistics;

receive at least one call; and take at least one modelled expected call into account as a received call in computing allocation decisions for the at least one call in the elevator system.

8. The elevator control apparatus according to claim 7, wherein the at least one memory stores program instructions that, when executed by the at least one processor, cause the apparatus to:

estimate elevator load in elevators of the elevator system based on the historical passenger traffic statistics; and take the estimated elevator load into account in computing subsequent allocation decisions in the elevator system.

9. The elevator control apparatus according to claim 8, wherein the at least one memory stores program instructions that, when executed by the at least one processor, cause the apparatus to:

estimate elevator load in elevators of the elevator system separately for each elevator trip based on passenger batch journey intensities and batch size distributions obtained from the historical passenger traffic statistics, and simulated service times.

10. The elevator control apparatus according to claim 7, wherein the modelled expected calls comprise at least one landing and car call pair.

11. The elevator control apparatus according to claim 7, wherein the modelled expected calls comprise at least one destination call.

12. The elevator control apparatus according to claim 7, wherein the passenger batch journey data comprises building origin-destination matrices formed separately for each day within a predetermined day cycle.

13. A computer program embodied on a non-transitory computer readable medium and comprising program code, which when executed by at least one processing unit, causes the at least one processing unit to perform the method of claim 1.

14. An elevator system comprising:

a plurality of elevators; and the elevator control apparatus according to claim 7.

15. The method according to claim 2, wherein the modelled expected calls comprise at least one landing and car call pair.

16. The method according to claim 3, wherein the modelled expected calls comprise at least one landing and car call pair.

17. The method according to claim 2, wherein the modelled expected calls comprise at least one destination call.

18. The method according to claim 3, wherein the modelled expected calls comprise at least one destination call.

19. The method according to claim 2, wherein the passenger batch journey data comprises building origin-destination matrices formed separately for each day within a predetermined day cycle.

20. A method for computing allocation decisions in an elevator system that uses immediate call allocation, the method comprising the steps of:

obtaining historical passenger batch journey data relating to the elevator system, wherein each passenger batch journey comprises an origin and a destination floor of the journey, the number of passengers of the journey and the time of the journey;

constructing historical passenger traffic statistics based on the passenger batch journey data;

modelling expected calls in the future based on the historical passenger traffic statistics;

receiving at least one call; and taking at least one modelled expected call into account as a received call in computing allocation decisions for the at least one call in the elevator system;

estimating elevator load in elevators of the elevator system separately for each elevator trip based on passenger batch journey intensities and batch size distributions obtained from the historical passenger traffic statistics, and simulated service times; and taking the estimated elevator load into account in computing subsequent allocation decisions in the elevator system.

* * * * *